US005597285A

United States Patent [19]

Meyer et al.

[11] Patent Number: 5,597,285

[45] Date of Patent: Jan. 28, 1997

[54] APPARATUS FOR FORMING STACKS

[75] Inventors: Erich Meyer, Schwaebisch Hall; Juergen Rothbauer, Michelfeld, both of Germany

[73] Assignee: Optima-Maschinenfabrik Dr. Bühler GmbH & Co., Schwaebisch Hall, Germany

[21] Appl. No.: 458,088

[22] Filed: Jun. 1, 1995

[30] Foreign Application Priority Data

Jun. 2, 1994 [DE] Germany ..... 44 19 329.7

[51] Int. Cl.[6] ..... B65G 57/11

[52] U.S. Cl. ..... 414/798.6; 271/178; 271/307; 414/798.5; 414/790.3

[58] Field of Search ..... 271/178, 307, 271/312; 414/790.3, 798.5, 798.6, 798.7; 198/728

[56] References Cited

U.S. PATENT DOCUMENTS

| | | | |
|---|---|---|---|
| 4,116,430 | 9/1978 | Winchester et al. | 414/798.7 X |
| 5,040,663 | 8/1991 | Gould et al. | 198/419.3 |

FOREIGN PATENT DOCUMENTS

| | | | |
|---|---|---|---|
| 18183 | 11/1990 | Australia . | |
| 344716 | 7/1992 | European Pat. Off. . | |
| 130024 | 3/1978 | German Dem. Rep. . | |
| 1245853 | 7/1967 | Germany | 198/728 |
| 2800657 | 8/1978 | Germany . | |
| 3232348 | 3/1984 | Germany . | |
| 3238888 | 4/1984 | Germany . | |
| 3410862 | 10/1985 | Germany . | |
| 3538309 | 5/1986 | Germany . | |
| 3700930 | 7/1988 | Germany . | |
| 3725225 | 7/1988 | Germany . | |
| 3827701 | 3/1989 | Germany . | |
| 4137855 | 5/1993 | Germany . | |
| 2-33059 | 2/1990 | Japan | 414/790.3 |
| 6-183630 | 7/1994 | Japan | 271/178 |
| 1329260 | 9/1973 | United Kingdom . | |
| 1364730 | 8/1974 | United Kingdom . | |
| 2186855 | 8/1987 | United Kingdom . | |

*Primary Examiner*—David A. Bucci
*Assistant Examiner*—Janice L. Krizek
*Attorney, Agent, or Firm*—Quarles & Brady

[57] ABSTRACT

An apparatus for forming stacks of individual articles, particularly diapers, contains a supply mechanism, which transfers the diapers successively and tangentially to a transfer device. The transfer device contains a plurality of revolving, tangentially positioned receptacles, which individually receive the articles. At a sequencing station the articles are then radially slid out of the receptacles, so that with a low impact speed and without spacing they form a stack.

20 Claims, 5 Drawing Sheets

APPARATUS FOR FORMING STACKS

Figure 1:
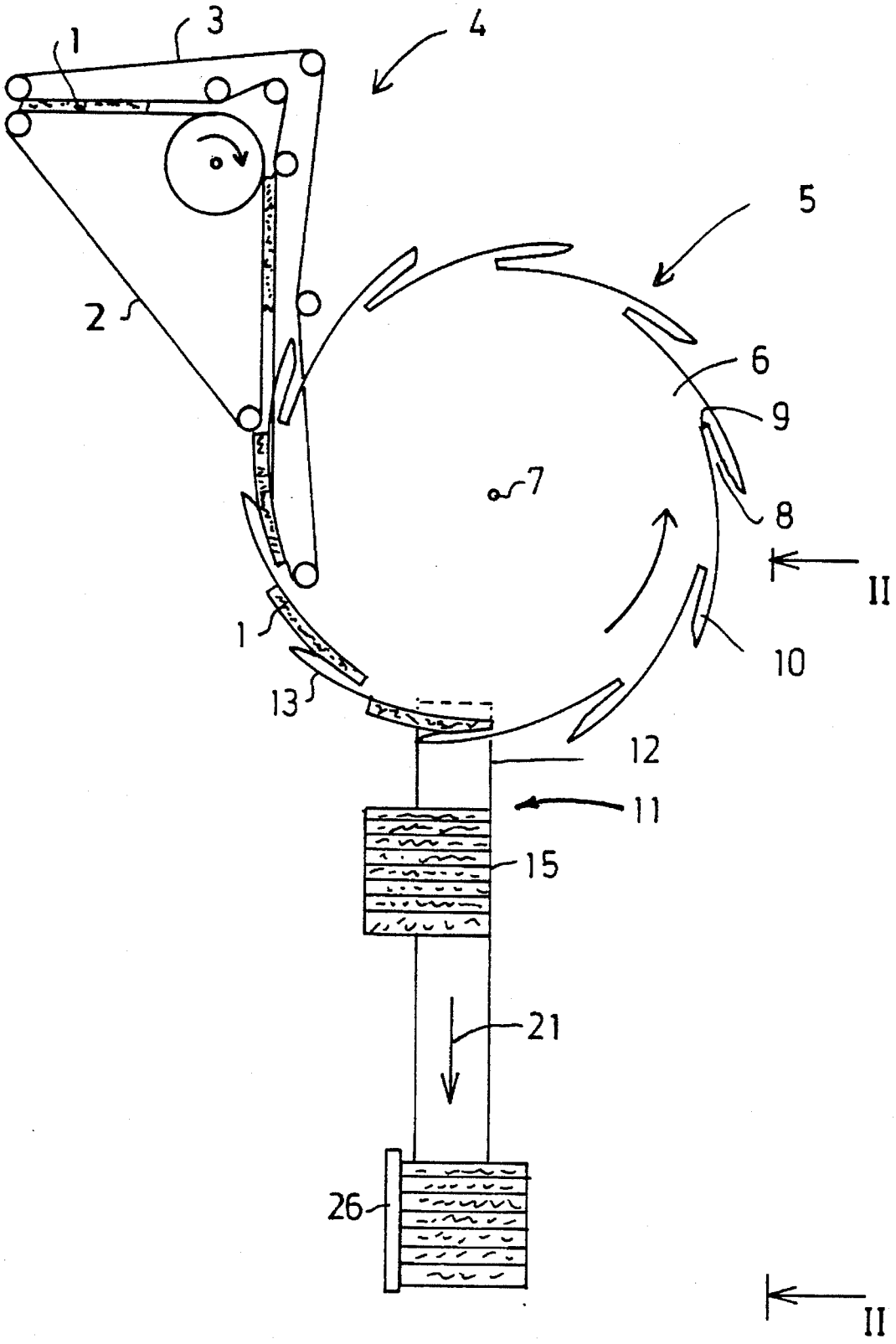

The invention relates to an apparatus for forming stacks from individually delivered articles. The articles are in particular diapers or sanitary towels, which are delivered by a production machine and are to be packed in stacks.

A method and apparatus for forming precisely numbered stacks are already known (DE 32 38 888 A1). The successively delivered articles are supplied to a rotating conveying mechanism in the form of a chain. They are inserted perpendicular to the rotary movement into individual compartments of the conveyor chain. This takes place at a reversal point, because there the compartments expand. Removal takes place in that with the aid of a slide several articles are simultaneously slid out of the compartments and drop onto a jointly moving table. On sliding out the articles have the same speed as the rotating conveying mechanism. On sliding out the individual articles have a reciprocal spacing. Prior to its further treatment the stack must be precompressed.

In an apparatus for producing the fold of the flap of envelopes (GB 1 329 260), it is known following the flap fold production taking place on the surface of rollers, to supply the envelopes to a rotating wheel, which has slots extending outwardly from the circumference in arcuate manner to the axis of the wheel. After rotating by 180° the envelopes leave the wheel roughly radially and consequently form a stack. The envelopes are shoved under an angle of approximately 45° in sloping manner on the stack.

In another known stacking apparatus (EP 344 716 B1) the articles to be stacked, namely paper handkerchiefs, are removed from a delivery wheel having individual receptacles and placed on a vertical stack. Such a vertical stack is only usable with very thin articles.

In addition, a method and an apparatus for stacking folded or unfolded paper blanks are known (DE-OS 37 00 930), in which the blanks are conveyed with the aid of a delivery wheel to a stack formation apparatus, where they slide out of the delivery wheel receptacles and are placed on a vertical stack.

The problem of the invention is to provide an apparatus of the aforementioned type more particularly usable for diapers and sanitary towels, which prevents damage or deformation and a jumping out of the product during stack formation and in which the stack requires no precompression.

To solve this problem the invention proposes an apparatus having the features of claim 1. Further developments of the invention form the subject matter of the subclaims.

Due to the fact that the transfer or delivery mechanism receives the articles tangentially and supplies them radially, during the formation of the stack the articles can be present without any reciprocal spacing, so that neither a precompression of the stack, nor an impacting of the articles with a relatively high speed occur. As a result there is a reduction of the risks of deformation and/or damage.

The rotating transfer mechanism can also be formed e.g. by a conveying chain, which is guided along a closed path.

According to the invention, the receptacles are constructed in such a way that they can in each case grip and hold an article and it is sufficient if this takes place in the vicinity of a front edge of the article in the supply direction. In order to obtain a precise orientation of the articles in the receptacles, it can be provided that they have a stop for the front edge of the particular article.

According to a further development of the invention the receptacles are constructed in pocket-like manner, i.e. at least in the vicinity of the leading edge of the article containing two side walls between which the articles are held.

According to the invention the tangential rotational speed of the rotating transfer mechanism is lower than the supply speed of the articles, which receives them from the supply device of the transfer mechanism. As a result of the fact that the articles lead compared with the tangential rotational speed the articles are shoved into the receptacles and then, if they are held by the transfer mechanism, they have already been released by the supply device.

According to the invention the rotational speed of the transfer mechanism can be up to 50% lower than the supply speed.

According to the invention the articles project out of the receptacles on at least one side and optionally also on both sides. They can then be accurately and elegantly sequenced by the sequencing mechanism. The sequencing mechanism includes a stop for engaging the articles located in the receptacles of the transfer mechanism when the articles reach the point of stacking.

This stop can in particular be positioned radially with respect to the transfer mechanism at this point, i.e. vertically with respect to the tangential speed and preferably in linear extension of the stack to be formed.

According to the invention the receptacles can have holding means for the articles and can be formed by the geometrical dimensions of the pockets, so that a certain clamping action occurs. However, it is in particular possible to use detachable holding means, e.g. detachable clips or in particular to use suction with the aid of underpressure. In this case both the start of holding and the release of the articles can be performed and controlled particularly easily. It is merely necessary at the corresponding point by means of a slide or the like to eliminate the underpressure, so that the articles are then released.

According to the invention, for forming the stacks, the apparatus can have a removal device with which the horizontal stack is moved away from the transfer mechanism in its own longitudinal direction, so that it can be packed. A horizontal arrangement of the stack in which the latter rests with its side e.g. on a shim, has the advantage compared with vertical stacking that there is no bending out under the weight of the stack, so that with such an arrangement larger stacks can be produced.

In particular the removal device can have at least two dogs moved along the same movement path and which enclose between them a stack whilst maintaining the compression thereof. One of the two dogs forms a stop against which the individual articles are conveyed by the transfer mechanism. As soon as the stack has the corresponding number of articles or the corresponding length, the second dog engages behind the last article in the stack, so that the latter is now held between these two dogs and can be moved on. In each case the last dog can simultaneously form the stop for the next stack.

According to the invention the removal device can additionally have a second movement path with at least two dogs moved along the same, the second movement path being placed on the stack side opposite to the first movement path. For example, the first movement path can be positioned below and the second above the stack. If possible the two movement paths are positioned to the right and left of the stack. For example, the upper movement path can extend over part of the length of the movement route of the stack.

According to a further development of the invention the dogs are at least roughly as long as the reciprocal spacing of the linear portions of the movement route. At the reversal point of the movement path, which is e.g. formed by a chain guided by means of a guide pulley, the dog tip moves on a circular arc around the spindle of said pulley. This leads to a higher linear speed of the dog tip and this can be utilized for a faster pivoting in of the dog behind a stack.

The dogs can be positioned or fixed e.g. on rotating chains, belts, straps, etc. guided by means of two guide pulleys or pinions. A guide pinion can be used for driving purposes.

According to a further development of the invention the dogs are guided in rails forming closed paths. In this case the dogs can also be driven by rotating chains, belts, etc., which are connectable to the dogs. In this case the chains are only used for driving purposes, whereas the guidance is brought about by the rails. It is consequently possible when re-equipping the apparatus for other stack sizes with limited costs to modify the reciprocal spacing of the dogs.

According to the invention the connection between the dogs and the driving means can be formed and detached during the operation of the apparatus. Thus, despite a constant rotation of the driving chains the dogs can be stopped at certain points, e.g. in order to stop a stack at the end of the conveying path, so that it can be laterally slid out by a slide.

For producing and detaching the connection, according to the invention coupling stations can be provided, which for a particular apparatus are located at specific fixed points thereof. Optionally on reequipping to different stack sizes the coupling stations can also be adjustably arranged.

For connecting the dogs to the driving mechanism it is in particular possible to provide on the dogs blocking elements, which engage under spring action in the driving mechanism. Thus, as soon as a connection is formed, it is retained as a result of the spring action. According to the invention the coupling station can have a movable decoupling element, which in its active position disengages the blocking element of a dog which has reached the coupling station from the driving mechanism. For example, the decoupling element can be a pin moved by an air cylinder and which in its active position engages on a starting bevel or some other part of the blocking element and disengages the same. Following the disengagement or release of the blocking element the dog remains at the location of the coupling station, whereas the driving mechanism moves on.

To ensure that a following dog does not have an interfering action, according to a further development of the invention the dog has a release element, which on approaching the next dog releases its blocking element from the driving mechanism. If the first dog is again coupled to the driving mechanism by retracting the decoupling element of the coupling station, it moves again and then the following dog is also recoupled. It then again arrives at the coupling station, where the latter can stop it again.

According to the invention the transfer or delivery wheel has a plurality of pivotable clips in the receptacles and these can be pivotable about pivot pins positioned concentrically to the rotation axis of said wheel, the pivoting being brought about by a curved guide. By pivoting the clips it is possible to fix the articles by jamming.

The invention more particularly proposes that the transfer mechanism has a transfer wheel rotating about a fixed spindle and on whose circumference are located the receptacles for the articles.

Further features, details and advantages of the invention can be gathered from the following description of two preferred embodiments of the invention and the attached drawings wherein show:

FIG. 1 Diagrammatically a plan view of the apparatus according to the invention.

Figure 2:
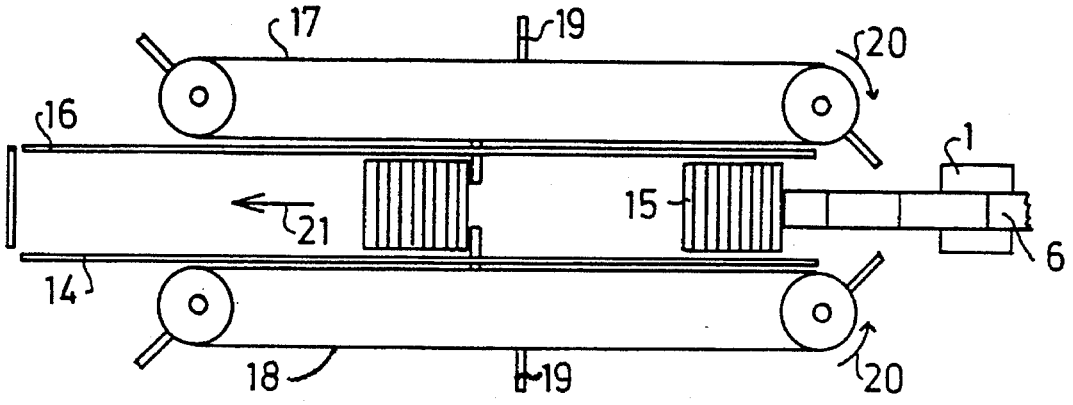

FIG. 2 A side view roughly along line II—II in FIG. 1.

Figure 3:
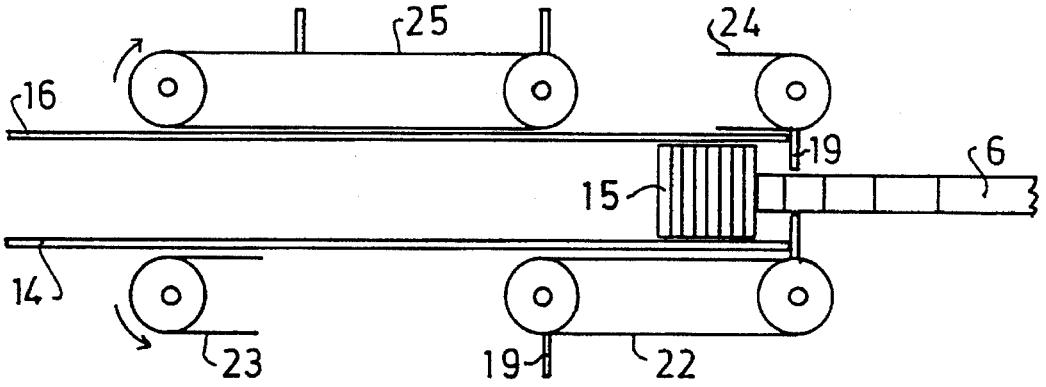

FIG. 3 A diagrammatic side view corresponding to FIG. 2 in the second embodiment.

Figure 4:
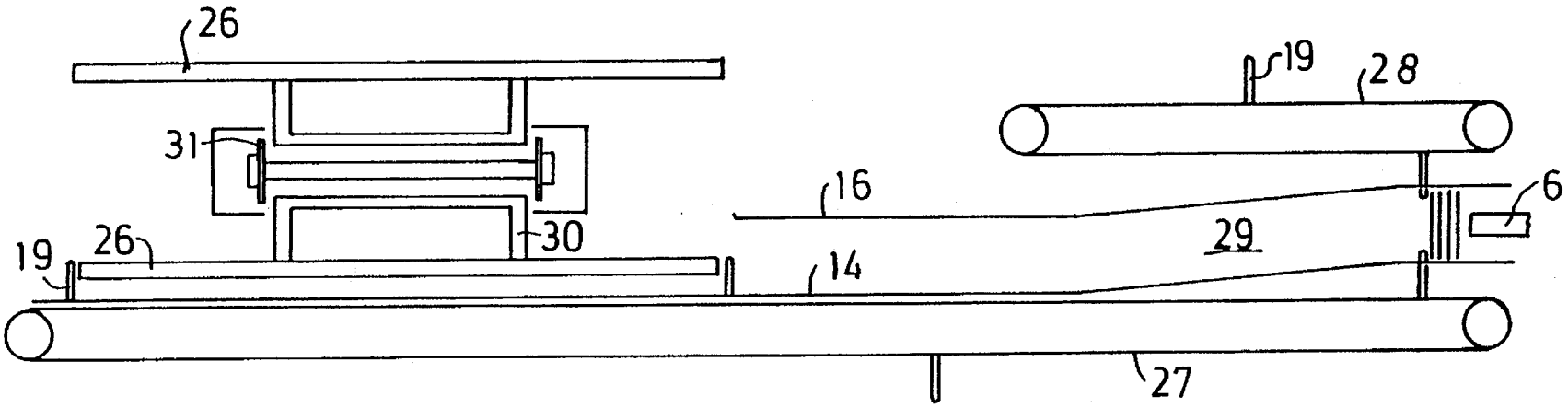

FIG. 4 A side view of an apparatus with a removal device.

Figure 5:
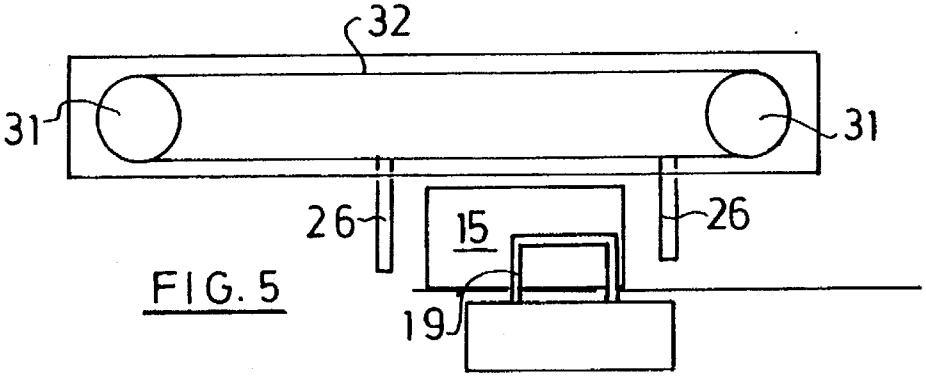

FIG. 5 A view of the arrangement of FIG. 4 from the left.

Figure 6:
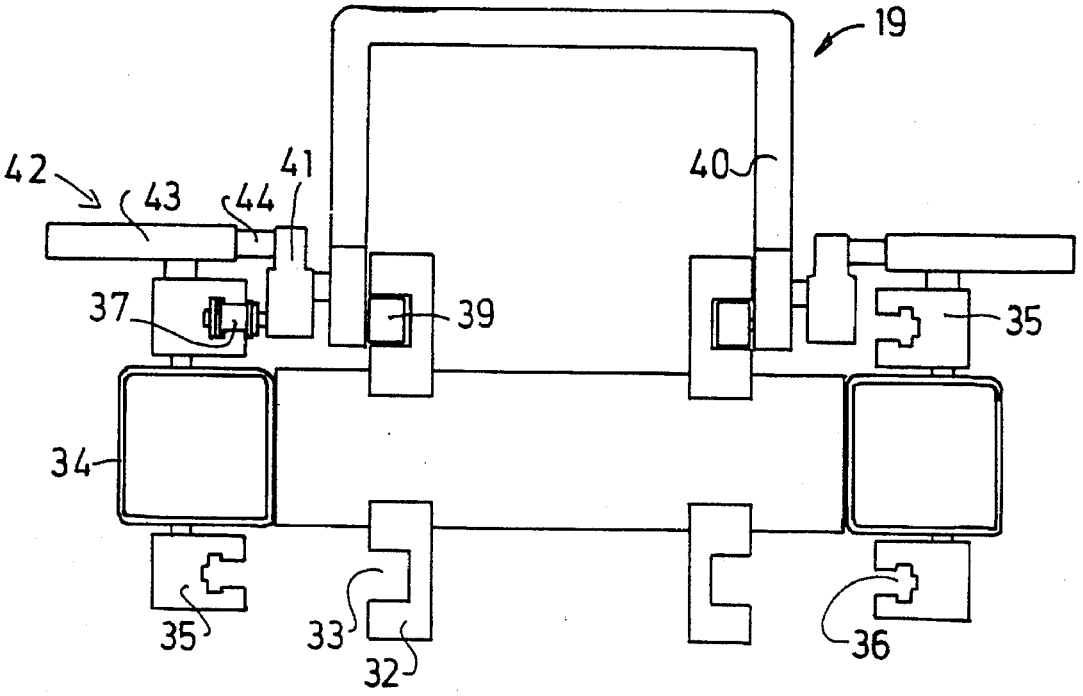

FIG. 6 On a larger scale a cross-section through a drive mechanism for moving a dog.

Figure 7:
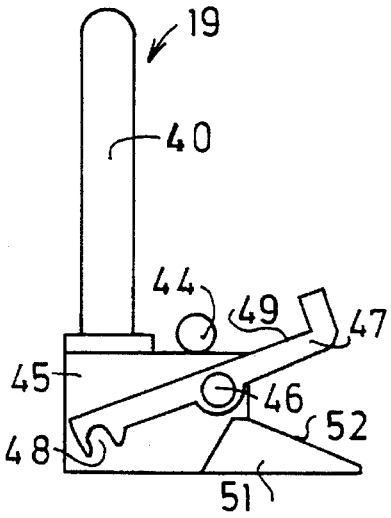

FIG. 7 A side view of a dog.

Figure 8:
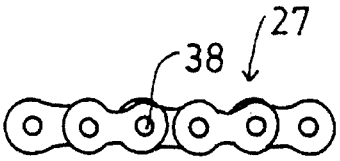
Figure 8:
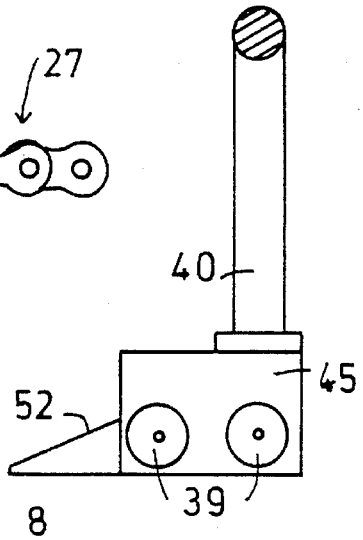

FIG. 8 A side view of the dog from the opposite side.

Figure 9:
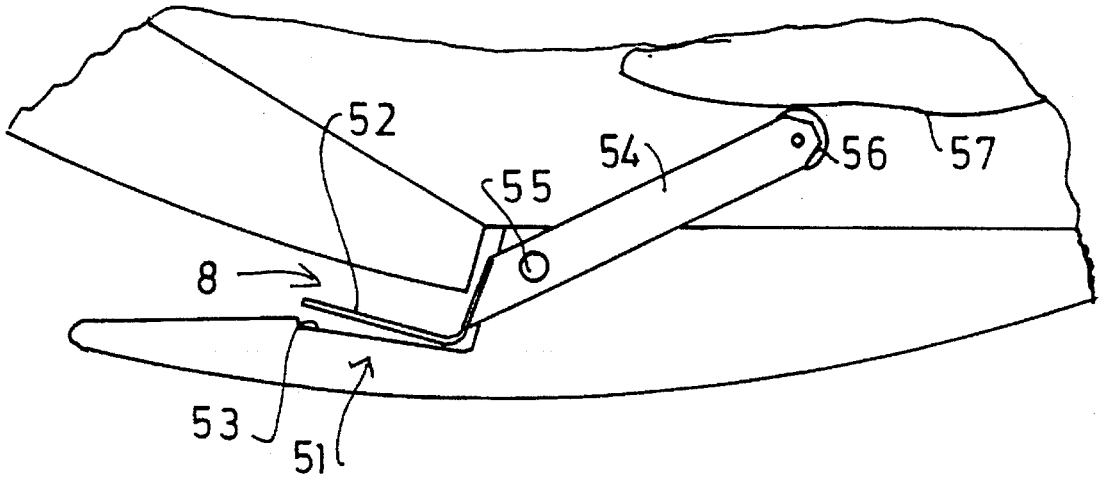

FIG. 9 A larger scale partial view of part of the transfer wheel.

Figure 10:
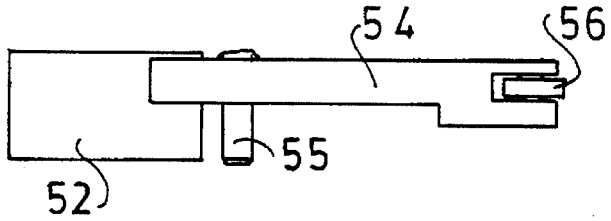

FIG. 10 A side view of the clip in FIG. 9.

FIG. 1 diagrammatically shows a plan view of an apparatus for forming a stack from individual articles 1, which are diapers or sanitary towels. The diapers are received from the manufacturing machine and held between and conveyed by two rotating belts 2, 3. The belts extend over corresponding guide and driving pulleys and are guided with a close reciprocal spacing, so that the articles 1 are held between them. In the supply device 4 bundled by the belts 2, 3 and the associated guide and driving pulleys in the represented embodiment there is a deflection by 90° which is intended for the specific case, where the actual packing machine (not shown) can be in a line with the production plant. If another solution is to be found at the corresponding installation point, the supply mechanism can obviously be differently positioned.

From the supply mechanism 4 the articles 1 are supplied tangentially to the circumference of a transfer device 5, which contains in the represented embodiment a rotating wheel 6, which rotates about a vertical, fixed spindle 7. The transfer device 5 contains in the vicinity of its outer circumference individual pocket-like receptacles 8, which are in each case bounded by a radially directed front wall 9. One side of the pocket-like receptacles 8, namely the radial inside, is formed by the wheel 6, whereas in the vicinity of the front wall is provided a finger-like outer wall 10. On its outside the outer wall 10 is curved and slopes with respect to the circumference.

The wheel 6 of the transfer device 5 rotates at such a speed that the circumferential speed is lower than the supply speed of the supply mechanism, so that the articles are moved by the belts 2, 3 into the receptacles 8 until engagement occurs with the front wall 9. In this position, which is already reached to the left in FIG. 1, the articles 1 are secured by suction on their radial inside, but a mechanical clamping is also possible.

In FIG. 1 on the underside of the transfer device 5 is provided a sequencing device 11 for the articles. In this case a linear stop 12 at right angles to the rotational path of the articles 1 is formed. The articles engage against said stop 12 during the rotation of the wheel 6, said stop preventing any further movement. On reaching this position the underpressure in the particular receptacle 8 is switched off or a mechanical clamping is released, so that the article 1, which is no longer able to move, is released by the transfer device 5. The outside 13 of the finger of the in each case following receptacle 8 now slides the article outwards at right angles with respect to the rotary path, the sliding out speed being much lower than the rotational speed of the transfer device 5. In this way at the stop 12 and the sequencing device 11 a stack of articles 1 is formed, which, as soon as it has reached a certain height, can be conveyed away.

During the production of diapers, which as a result of the folding action have two different front sides, the stack is to be formed in such a way that a certain orientation is retained. In the case of the presently proposed transfer device this is made possible, whereas in the prior art it is necessary to have a further device for rotating the product after unstacking.

FIG. 2 shows a diagrammatic side view of the arrangement of FIG. 1 from the right in the latter. Thus, to the right it is possible to see the wheel 6 of the transfer device 5, which is constructed as a flat disk, whose thickness is smaller than the width of the articles 1, so that the latter project upwards and downwards out of the receptacles 8, i.e. laterally with respect to the conveying direction. As a result the articles 1 above and/or below the wheel 6 can engage against the stop 12 shown in FIG. 1. This stop simultaneously forms the line along which the stack is to be formed.

The delivered articles are delivered at a height such that they stand on a lower sliding plate 14. The distance between the formed stack 15 and the sliding plate 14 is increased in the drawing. So that the individual articles continue to stand there and do not tip over, at least the lower sliding plate 14, but preferably also an upper sliding plate 16, are subject to vacuum action, so that the stack 15 is retained. At least one of the plates 14 and 16 can be resiliently mounted in order to compensate tolerances in the product. As soon as a stack has reached the desired height, it is moved away by a removal device. In the embodiment shown in FIG. 2 it has an upper stacking chain 17 and a lower stacking chain 18, both chains being synchronously operated. On the outsides and at certain intervals they contain individual studs 19, which extend outwards at right angles with respect to the chain. To the right in FIG. 2 it is possible to see two studs 19, which are positioned shortly upstream of their engagement position. On further moving the chains 17, 18 in the direction of the arrows 20 the studs 19 engage on the wide side of the furthest right article 1 of the stack and then move said stack 15 away from the transfer device 5 to a point at the bottom in FIG. 1 from where the finished stack is supplied to the packing mechanism by means of a slide 26, said mechanism not being shown in the drawings. The sliding into the sliding out position consequently takes place in the direction of the arrow 21, whereas the sliding out into the packaging mechanism is at right angles thereto. The studs 19 can either engage on the stacks on both sides of the upper and lower sliding plates or can be passed through slots in said plates.

In FIG. 3 the stack removal device is somewhat modified compared with FIG. 2 and above and below the stack 15 to be formed it has in each case two stacking chains 22, 23, 24, 25 and for reasons of simplification in FIG. 3 at the bottom is shown the front stacking chain 22 and at the top the rear stacking chain 25. The pair of front stacking chains 24 moves with the studs 19 the stack to only a limited extent to the left, where the further conveying is taken over by the studs 19 of the second pair of stacking chains 23, 25. Here again the stack 15 is removed to a transfer position from where the finished stack can be conveyed to the packaging machine.

It has been shown that the apparatus allows at limited cost a stack formation with a low impact speed and without reciprocal spacing.

FIG. 4 diagrammatically shows another embodiment which, except from the transfer wheel to the right, is identical with the preceding embodiments. Once again the stacks 15 of articles to be stacked are formed between a lower sliding plate and an upper sliding plate 16.

Below the lower plate 14 is formed a driving mechanism with dogs 19, extending over the entire length of the apparatus up to the removal station. For simplified representation purposes the dogs can be considered as dogs 19 fitted to a rotating chain 27.

Above the upper sliding plate 16 is provided a revolving chain 28 with dogs 19 fitted thereto. Both chains 27, 28 are driven in opposition at the same linear speed. For forming a stack two dogs 19 are positioned somewhat outside the circumference of the transfer wheel 6, which supplies individual articles 1 and slides these perpendicularly outwards against the two dogs 19 located at the same point and which consequently act as a stop for the stack 15. With the speed with which the articles 1 are supplied to the outside, the dogs 19 forming the stack move away from the wheel 6, i.e. to the left in FIG. 4. This takes place until a complete stack has formed. The next dog 19 moved up to the particular chain 27, 28 is then pivoted in behind the stack 15, so that there is a complete stack between the dogs.

The sliding plates 14, 16 are positioned in the area immediately alongside the transfer wheel 6 and at the same height as the latter, so that the individual diapers 1 to be packed are introduced between them. To this horizontal part of the sliding plates 14, 16 is connected an area 29 in which both sliding plates 14, 16 pass in sloping manner downwards whilst retaining their parallelism and there transfer again to a horizontal path. During the sloping path of the sliding plates the dog 19 of the upper chain 28 forming the stop is disengaged from the stack 15, whilst simultaneously the dog 19 of the lower chain 27 is moved in laterally into the path of the stack 15.

At the end of the movement path the stack is then positioned between the two dogs 19 furthest left in FIG. 4 at a point where the stack can be laterally slid out with the aid of the slide 26. The slide 26 is fitted with the aid of shackles 30 to a chain guided by means of guide pinions 31. By driving the pinions 31 the slide 26 is moved. Here again there are several slides 26 with the aid of the shackles 30.

This final removal process is illustrated in FIG. 5, which is a view from the left of FIG. 4. The slides 26 are fitted to the chain 32. By driving action the stack 15 is moved out to the right in FIG. 5, from where it passes to a further packaging machine station.

The arrangement of FIG. 4 shows that the stack is conveyed on between the dogs, whilst maintaining its compression. The guidance points of the dogs 19 in the vicinity of the transfer wheel 6, as a result of the relatively great length of the dogs 19, i.e. their dimension perpendicular to the chains 27, 28 leads to the outer ends initially engaging on the articles 1 moving relatively rapidly.

In the position shown to the left in FIG. 4 when a stack 15 of articles is immediately upstream of the slide 26, it is appropriate for the lateral sliding out of said stack and is proposed by the invention that the dogs 19 enclosing the stack between them are briefly stopped. For this purpose the dogs 19 are guided in the manner illustrated by FIGS. 6 to 8.

FIG. 6 shows a cross-section through the driving and conveying mechanism, e.g. a cross-section through FIG. 4 and for simplification reasons only one dog 19 of the lower chain 27 is shown. The lower chain 27, like the upper chain 28, forms a movement route, which comprises two parallel, linear portions, which are connected by two semicircles.

FIG. 6 shows a pair of rails 32, each rail 32 also defining such a movement route, such as is exhibited by a chain tensioned between two wheels. The two rails 32 are parallel to one another and have guide slots 33 in their outwardly directed sides.

On the outsides and parallel to the rails 32 are two metal pipes 34, on whose top and bottom are fixed in each case further rails 35. The rails 35 contain longitudinally directed slots 36, in which are guided the chain links 37 of the lower driving chain 27. The chain links 37 have inwardly directed, projecting chain studs 38. The slots 35 are horizontally aligned with the slots 33 of the rails 32.

In the slots 33 of the rails 32 are guided rolls 39, which are fitted in rotary manner to the end of the shackle 40 forming the dog 19. Thus, the dogs 19 are displaceably guided along the rails 32.

On the outside of the ends of the shackle 40 are mounted in rotary manner blocking elements 41, which are subject to the action of a not shown torsion spring. The blocking elements are so constructed that in the represented spring-urging position they engage in a chain stud 38 of the chain link 37 of the chain 27. Thus, the dog 19 is also moved on driving the chain 27.

At certain points of the rotary path in FIG. 4, e.g. at the point of the left-hand dog 19 in FIG. 4, coupling stations 42 are provided. These coupling stations 42 contain an air cylinder 43 with a decoupling element 44, which can be extended and retracted by the air cylinder 43. The coupling stations 42 are arranged in fixed manner on the rails 35 or the pipes 34.

FIG. 7 shows a side view of a dog 19 from the outside. The shackle 40 has a foot or base part 45, to whose outside on a pivot pin 46 is articulated the blocking element 41 in the form of a blocking lever 47. It is a two-arm lever, which is spring-urged counterclockwise in FIG. 7. On its one end a hook 48 is formed on the blocking lever 47 and its U-shaped inner opening corresponds to the diameter of a chain stud 38. The chain 27 is only partly shown, but is in the correct position. In the represented position of the blocking lever 47 the hook 48 engages over a chain stud 38 located at this point, so that the dog 19 is joined to the chain. In order to decouple the dog 19, the decoupling element 44 of the air cylinder 43 is extended, so that it comes into the path of the top 49 of the blocking lever, so that the decoupling element 44 slides off on the top 49 and the lever is pivoted clockwise until it is disengaged from the chain stud 38, so that the dog 19 is no longer joined to the chain 27 and remains stationary.

If the dog 19 is to be moved on again, then the decoupling element 44 is retracted with the aid of the air cylinder 43, so that the blocking lever 47 under the action of the spring, is again pivoted counterclockwise in FIG. 7 and restores the coupling with the chain 27.

FIG. 8 shows the view of the base part of the dog 19 from the other side. Two rolls 39 are mounted on its inside.

FIGS. 7 and 8 again show a release member 51 with a sloping cam face 52, so that if e.g. the dog 19 in FIG. 7 is at a decoupling station with the activated decoupling element 44, it is possible that a further dog will approach from the right in FIG. 7. This dog cannot pass completely up to the coupling station 42, because there is already a dog there. Thus, when it approaches the latter dog, the hook end of its blocking lever 47 slides onto the cam face 52 of the release member 51, so that the blocking lever 47 is pivoted and consequently the connection with the chain 27 is released. Thus, also the dog 19 is decoupled from the drive.

FIG. 9 diagrammatically shows a partial view of the transfer wheel 6. In the receptacle 8 of the transfer wheel is located a clip 51, which is used for fixing the articles to be transferred. It contains a leg 52, which is positioned in a flat recess 53. The leg 52 is connected to a lever 54, which is pivotably mounted in a spindle 55. On the free end of the lever 54 is rotatably mounted a roll 56, which cooperates with a curve or cam 57. For opening the clip 51 the lever is pivoted counterclockwise until the leg 52 rests on the bottom of the recess 53. For closing purposes the lever 54 is pivoted clockwise into the represented position. Pivoting takes place with the aid of the cam 57, which is rigidly connected to the transfer wheel 6.

We claim:

1. Apparatus for forming stacks from a plurality of individual articles formed of sheet products that are folded to provide said articles with front ann back faces, top and bottom edge surfaces and opposite end surfaces, said apparatus comprising:

a supply mechanism that moves the articles in a longitudinal direction, such that each article is lead by a leading one of the opposite end surfaces;

a revolving transfer wheel having a central circular portion with a periphery and with a plurality of receptacles, each receptacle having a closed end located along a circumference of said central circular portion, each receptacle extending from said closed end to an open end along approximately a tangent from the periphery of said central circular portion, wherein a leading one of said opposite end surfaces of a respective one of said articles is fed into a respective one of said receptacles and is retained therein, so that each article is carried by said revolving transfer wheel in an arcuate path around a portion of said circumference to translate positioning of said articles from longitudinal to transverse, said receptacles being positioned to hold said articles in a non-bending position and in non-overlapping relation to each other a sequencing device including first means for stopping movement of the leading end surface of each respective article carried by said transfer wheel as each of said articles passes said sequencing device so as to remove said individual articles from their respective receptacles, said sequencing device having second means for stacking said articles at a point where the articles are stopped, said articles being positioned transversely in a stack formed along a stacking path running approximately parallel to a radius of said transfer wheel.

2. Apparatus for forming stacks according to claim 1, wherein the receptacles have a stop for receiving the leading one of said opposite end surfaces of the article as the article is moved in the longitudinal direction.

3. Apparatus for forming stacks according to claim 1, wherein the receptacles each have a pocket-like construction.

4. Apparatus for forming stacks according to claim 1, wherein the receptacles are moved along the arcuate path at a speed that is approximately 50% lower than a speed at which the articles are moved in a longitudinal direction from the supply mechanism to the transfer wheel.

5. Apparatus for forming stacks according to claim 1, wherein each receptacle has an open top side and an open bottom side and wherein each article projects out of at least one of the open end, the open top side and the open bottom side of the receptacle to be stopped by the sequencing device.

6. Apparatus for forming stacks according to claim 1, wherein said second means of the sequencing device is a stop, against which the articles engage upon reaching the sequencing device.

7. Apparatus for forming stacks according to claim 1, wherein receptacles have means for holding the articles.

8. Apparatus for forming stacks according to claim 1, wherein the transfer wheel revolves about a fixed spindle.

9. Apparatus according to claim 1, wherein the second means stacks a plurality of articles to form a stack that is longer than a dimension of an individual article from one end surface to an opposite end surface of said article.

10. Apparatus according to claim 9, wherein said stacking path has longitudinal segments including a first run and a second run and the second means has at least a first pair of dogs spaced along one side of the stacking path so as to hold a stack between said dogs along said first run of said stacking path for said articles.

11. Apparatus according to claim 10, wherein the second means has at least a second pair of spaced apart dogs along the second run of said stacking path and on an opposite side of said stacking path for holding a stack between them.

12. Apparatus according to claim 10, wherein the first pair of dogs are at least approximately as long as the spacing between the first and second runs of the stacking path.

13. Apparatus according to claim 10, wherein the dogs are fixed to drive means in an endless loop that is disposed over two guide pulleys.

14. Apparatus according to claim 10, wherein the dogs are guided in rails formed in closed paths and have a connection to said drive means, said drive means including chains arranged in an endless loop.

15. Apparatus according to claim 14, wherein the connection to said drive means can be formed and released during the operation of the apparatus.

16. Apparatus according to claim 14, wherein coupling stations are provided for forming and releasing the connection.

17. Apparatus according to claim 14, wherein the dogs are blocking elements, which engage under spring action in the driving means.

18. Apparatus according to claim 16, wherein each coupling station has a moveable decoupling element, which in the activated position releases from the driving means a dog reaching the coupling station.

19. Apparatus according to claim 17, wherein the dogs have a release member which, when the next dog approaches, releases its blocking element from the driving means.

20. Apparatus for forming stacks from a plurality of individual articles formed of sheet products that are folded to provide said articles with front and back faces, top and bottom edge surfaces and opposite end surfaces, said apparatus comprising:

a supply mechanism that moves the articles in a longitudinal direction, such that each article is lead by a leading one of the opposite end surfaces;

a revolving transfer wheel having a central circular portion with a periphery and with a plurality of receptacles, each receptacle having a closed end located along a circumference of said central circular portion, each receptacle extending from said closed end to an open end along approximately a tangent from the periphery of said central circular portion, wherein a leading one of said opposite end surfaces of a respective one of said articles is fed into a respective one of said receptacles and is retained therein to be carried by said revolving transfer wheel in an arcuate path around a portion of said circumference to translate positioning of said articles from longitudinal to transverse, a sequencing device including first means for stopping movement of leading end surfaces of the respective articles carried by said transfer wheel as each of said articles passes said sequencing device so as to remove said individual articles from their respective receptacles, said sequencing device having second means for stacking said articles at a point where the articles are stopped and position transversely in a stack formed along a stacking path running approximately parallel to a radius of said transfer wheel; and wherein the transfer wheel has clips in the receptacles that are pivoted by a cam in such a way that the articles are jammed into respective receptacles.

* * * * *